US011346612B2

(12) United States Patent
Yin et al.

(10) Patent No.: US 11,346,612 B2
(45) Date of Patent: May 31, 2022

(54) PLATE HEAT EXCHANGER

(71) Applicant: Zhejiang Sanhua Intelligent Controls Co., Ltd, Shaoxing (CN)

(72) Inventors: Fangfang Yin, Hangzhou (CN); Jiang Zou, Hangzhou (CN); Wei Zhang, Hangzhou (CN); Jiabin Ye, Hangzhou (CN); Gang Lv, Hangzhou (CN)

(73) Assignee: Zhejiang Sanhua Intelligent Controls Co., Ltd., Shaoxing (CN)

( * ) Notice: Subject to any disclaimer, the term of this patent is extended or adjusted under 35 U.S.C. 154(b) by 475 days.

(21) Appl. No.: 16/325,812

(22) PCT Filed: Aug. 22, 2017

(86) PCT No.: PCT/CN2017/098440

§ 371 (c)(1),
(2) Date: Feb. 15, 2019

(87) PCT Pub. No.: WO2018/036467

PCT Pub. Date: Mar. 1, 2018

(65) Prior Publication Data

US 2021/0239404 A1 Aug. 5, 2021

(30) Foreign Application Priority Data

Aug. 25, 2016 (CN) ..... 201610733702.X

(51) Int. Cl.

| | |
|---|---|
| ***F28D 9/00*** | (2006.01) |
| ***F28F 3/08*** | (2006.01) |
| *F28F 9/24* | (2006.01) |

(52) U.S. Cl.

CPC ..... *F28D 9/005* (2013.01); *F28D 9/0056* (2013.01); *F28F 3/08* (2013.01); *F28F 9/24* (2013.01); *F28F 2275/06* (2013.01)

(58) Field of Classification Search

CPC ..... F28D 9/005; F28D 9/0056; F28D 9/0043; F28D 9/0068; F28F 3/08; F28F 9/24; F28F 2275/06

See application file for complete search history.

(56) References Cited

U.S. PATENT DOCUMENTS 3,117,624 A * 1/1964 Fritz ..... F28D 9/005 165/139
3,631,923 A * 1/1972 Izeki ..... F28D 9/005 165/167

(Continued)

FOREIGN PATENT DOCUMENTS

| | | |
|---|---|---|
| CN | 2821502 | 9/2006 |
| CN | 103217049 | 7/2013 |

(Continued)

OTHER PUBLICATIONS

Extended EP Search Report dated Feb. 26, 2020 in corresponding EP Ap. No. 17842890.0.

*Primary Examiner* — Eric S Ruppert
*Assistant Examiner* — Hans R Weiland
(74) *Attorney, Agent, or Firm* — Boyle Fredrickson S.C.

(57) ABSTRACT

A plate heat exchanger includes a first plate sheet and a second plate sheet. A blocking member is disposed between a front surface of the second plate sheet and a back surface of the first plate sheet. The blocking member is located between a first corner hole and a second corner hole of the second plate sheet, and one end of the blocking member is located on a side portion of the second plate sheet. A first corner hole of the second plate sheet bypasses the other end of the blocking member to communicate with a second corner hole of the second plate sheet. In the plate heat exchanger, a blocking member is disposed between two (Continued)

plate sheets, accordingly fluid can be evenly distributed, and the plate heat exchanger has good heat exchange performance.

10 Claims, 5 Drawing Sheets

(56) References Cited

U.S. PATENT DOCUMENTS

| | | | | |
|---|---|---|---|---|
| 9,228,784 | B2 * | 1/2016 | Reif | F28D 9/005 |
| 2001/0054501 | A1 * | 12/2001 | Wehrmann | F28D 9/005 165/166 |
| 2002/0026999 | A1 * | 3/2002 | Wu | F28D 9/005 165/167 |
| 2004/0226703 | A1 * | 11/2004 | Blomgren | F28D 9/005 165/167 |
| 2007/0023175 | A1 * | 2/2007 | Richter | F28D 9/005 165/167 |
| 2007/0261832 | A1 * | 11/2007 | Ware | F28D 9/005 165/167 |
| 2009/0008071 | A1 * | 1/2009 | Miao | F28D 9/005 165/167 |
| 2010/0258285 | A1 * | 10/2010 | Yao | F28D 9/005 165/167 |
| 2014/0116649 | A1 * | 5/2014 | Cho | F28D 9/005 165/96 |
| 2016/0245591 | A1 * | 8/2016 | Masgrau | F28D 9/005 |
| 2016/0356560 | A1 * | 12/2016 | Wei | F28D 9/005 |
| 2017/0030255 | A1 * | 2/2017 | Tokozakura | F28D 9/005 |
| 2017/0152766 | A1 * | 6/2017 | Andersson | F01N 5/02 |

FOREIGN PATENT DOCUMENTS

| | | | | |
|---|---|---|---|---|
| CN | 103424024 | | 12/2013 | |
| CN | 204007246 | | 12/2014 | |
| DE | 19547185 | | 6/1997 | |
| JP | 6183882 | | 4/1986 | |
| KR | 20010108765 | | 12/2001 | |
| WO | WO-2010013608 | A1 * | 2/2010 | F28F 3/083 |

* cited by examiner

PLATE HEAT EXCHANGER

CROSS-REFERENCE TO RELATED APPLICATIONS

This application is the national phase of International Application No. PCT/CN2017/098440, titled "PLATE HEAT EXCHANGER", filed on Aug. 22, 2017, which claims the priority to Chinese Patent Application No. 201610733702.X titled "PLATE HEAT EXCHANGER", filed with China National Intellectual Property Administration on Aug. 25, 2016, the entire disclosures thereof are incorporated herein by reference.

TECHNICAL FIELD

The present application relates to a heat exchange device, and in particular to a plate heat exchanger.

BACKGROUND OF THE INVENTION

A plate heat exchanger is a compact and efficient heat exchanger, which is widely used in power, chemical, air conditioning and other industries, and it is also a key device in new energy applications such as waste heat utilization. In the air conditioning system, the plate heat exchanger is usually used as an evaporator and a condenser. In the new energy automobile, the plate heat exchanger is used in the battery thermal management system for performing heat exchange between the refrigerant and the cooling liquid.

Generally, according to different positions of the inlet and outlet of the refrigerant, the plate heat exchanger may be classified into two types, one type is that the inlet and outlet of the refrigerant are at different sides, which is called a "diagonal flow" plate heat exchanger, and the other type is that the inlet and outlet of the refrigerant are at the same side, which is called an "unilateral flow" plate heat exchanger. In some special working conditions, the size, volume and weight of the plate heat exchanger are limited, especially in automobiles. For some small-sized plate heat exchangers, the flow of the refrigerant is apt to be unevenly distributed due to the short passage of the refrigerant, and the uneven flow distribution may result in lower heat exchange efficiency.

Therefore, a technical problem to be addresses is to provide a heat exchange device with uniform flow distribution and good heat exchange performance.

SUMMARY OF THE INVENTION

In order to solve the above technical problem, the following technical solution is adopted in the present application. A plate heat exchanger includes a heat exchange core, and a first flow passage and a second flow passage isolated from each other are formed in the heat exchange core. The heat exchange core includes first plates and second plates. Each of the first plates includes a front surface at a side facing an adjacent second plate, and a back surface at another side opposite to the front surface. Each of the second plates includes a front surface at a side facing an adjacent first plate, and a back surface at another side opposite to the front surface. Portions of the second flow passage are formed between the front surfaces of the first plates and the back surfaces of the adjacent second plates, and portions of the first flow passage are formed between the front surfaces of the second plates and the back surfaces of the adjacent first plates. The first plate includes a first corner hole, a second corner hole, a third corner hole and a fourth corner hole, the second plate also includes a first corner hole, a second corner hole, a third corner hole and a fourth corner hole, and the first corner hole, the second corner hole, the third corner hole and the fourth corner hole of the first plate are arranged to correspond to the first corner hole, the second corner hole, the third corner hole and the fourth corner hole of the second plate, respectively.

The first corner hole and the second corner hole of the second plate are in communication with each other, and a blocking member is arranged between the front surface of the second plate and the back surface of the first plate. The blocking member is located between the first corner hole and the second corner hole of the second plate. One end of the blocking member is located at a side portion of the heat exchange core, and the first corner hole of the second plate bypasses another end of the blocking member to communicate with the second corner hole of the second plate.

According to the plate heat exchanger of the present application, by providing the blocking member between the front surface of the second plate and the back surface of the first plate, the fluid can be evenly distributed, so that the plate heat exchanger has better heat exchange performance.

DETAILED DESCRIPTION OF EMBODIMENTS

Hereinafter, specific embodiments of the present application will be illustrated in detail in conjunction with accompanying drawings.

Figure 1:
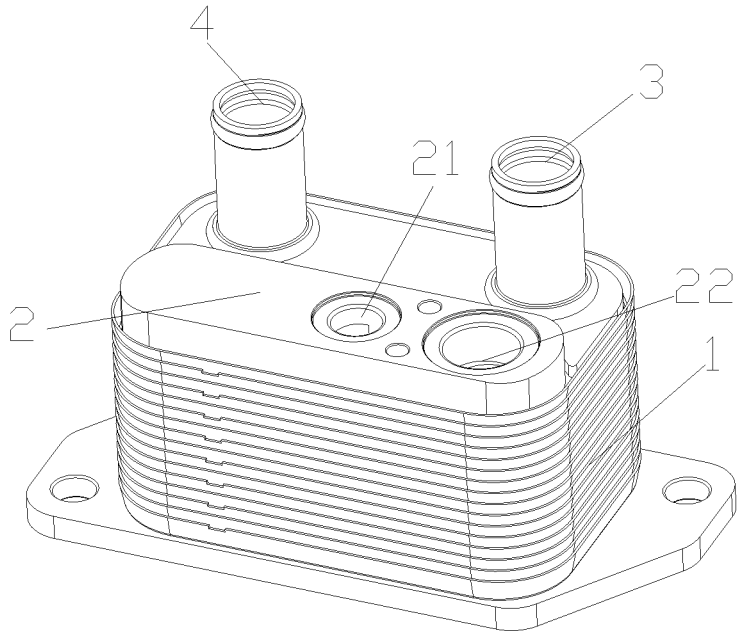
FIG. 1 is a perspective structural view of an embodiment of a plate heat exchanger according to the present application.

FIG. 1 is a perspective structural view of a plate heat exchanger according to the present application. As shown, the plate heat exchanger includes a heat exchange core 1, and a first flow passage and a second flow passage isolated from each other are formed in the heat exchange core. The plate heat exchanger further includes an adapting block 2, and the adapting block 2 is provided with a first connecting opening 21 and a second connecting opening 22, wherein both the first connecting opening 21 and the second connecting opening 22 are in communication with the first flow passage, and the first connecting opening 21 is in communication with the second connecting opening 22 through the first flow passage. The plate heat exchanger further includes a third connecting opening 3 and a fourth connecting opening 4, both the third connecting opening 3 and the fourth connecting opening 4 are in communication with the second flow passage, and the third connecting opening 3 is in communication with the fourth connecting opening 4 through the second flow passage. It should be clarified herein that the plate heat exchanger may not be provided with the adapting block 2, but be provided with a first connecting opening and a second connecting opening as the third connecting opening and the fourth connecting opening. In this embodiment, by providing the adapting block, a distance between the first connecting opening and the second connecting opening can be set as needed, so as to facilitate the installation of the plate heat exchanger and a throttle element (not shown in the figure).

Figure 2:
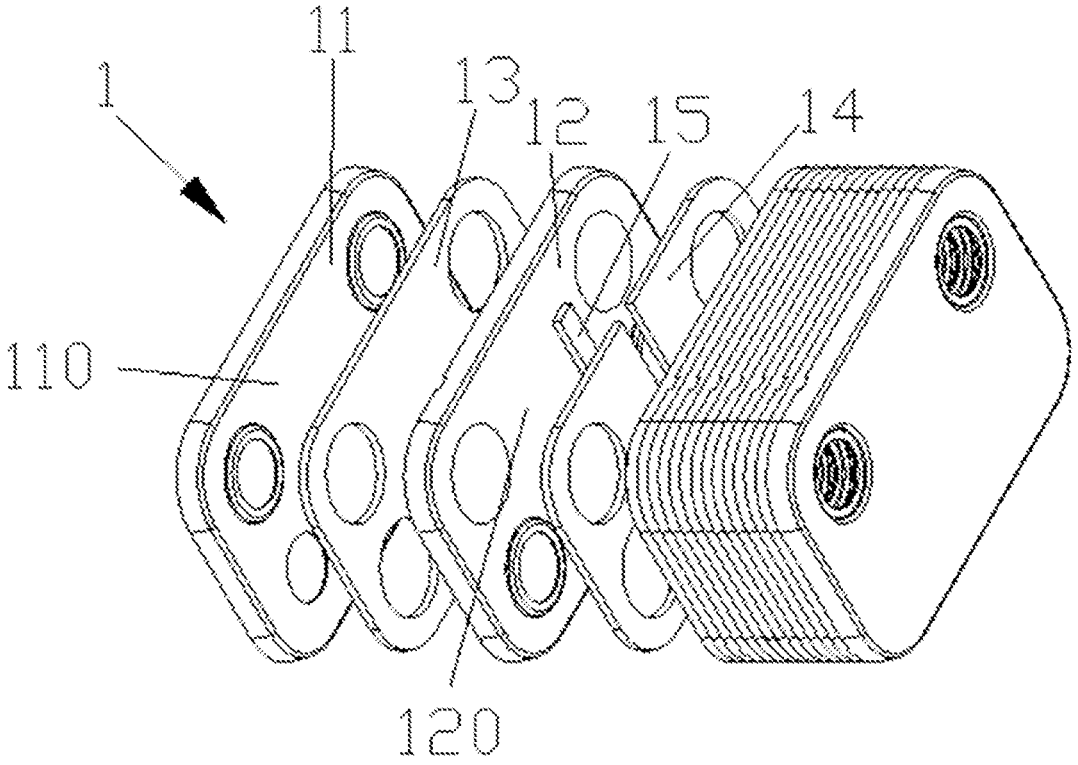
FIG. 2 is a partial exploded view of a heat exchange core of the plate heat exchanger shown in FIG. 1.

As shown in FIG. 2, the heat exchange core 1 includes first plates 11, second plates 12, first fins 13, second fins 14, and baffles 15. Each of the first fins 13 is arranged between a front surface 110 of a corresponding first plate 11 and a back surface of a corresponding second plate 12, and each of the second fins 14 and each of the baffles 15 are arranged between a front surface 120 of a corresponding second plate 12 and a back surface of a corresponding first plate 11. Portions of the second flow passage are formed between front surfaces 110 of the first plates 11 and back surfaces of the second plates 12, and portions of the first flow passage are formed between front surfaces 120 of the second plates 12 and back surfaces of the first plates 11. In this embodiment, the first plate 11 and the second plate 12 may be obtained by horizontally rotating a same plate by 180 degrees, of course, the first plate 11 and the second plate 12 may also be two plates of different structures. Moreover, the number of the portions of the second flow passage formed between the front surfaces 110 of the first plates 11 and the back surfaces of the second plates 12 is n1, and the number of the portions of the first flow passage formed between the front surfaces 120 of the second plates 12 and the back surfaces of the first plates 11 is n2, n2 is greater than n1, and $n2-n1=1$.

Figure 3:
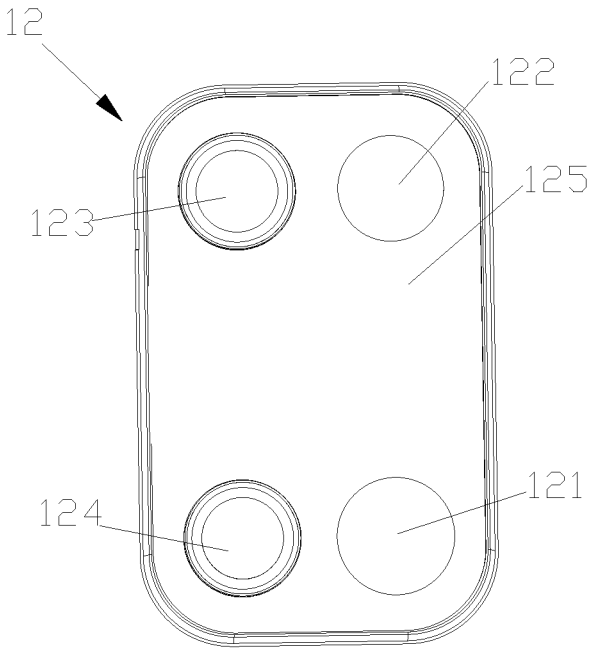
FIG. 3 is a schematic view showing the structure of a second plate of the plate heat exchanger shown in FIG. 1.

The plates of this embodiment are illustrated hereinafter by taking the second plate 12 as an example. As shown in FIG. 3, the second plate 12 includes a plate plane 125, and a first corner hole 121, a second corner hole 122, a third corner hole 123 and a fourth corner hole 124 which are located at four corners of the plate plane 125, respectively. The second plate 12 further includes a flanging structure enclosing the plate plane 125. The flanging structure protrudes from the plate plane 125 by a certain distance. Herein, one side surface of the second plate 12 enclosed by the flanging structure is defined as the back surface of the second plate 12, and the other side surface opposite to the back surface is defined as the front surface of the second plate 12. Circumferential sides of the third corner hole 123 and the fourth corner hole 124 are formed with annular bosses protruding from the plate plane 125 by a certain distance. Thus, in a case that the first plate 11 and the second plate 12 are stacked together, the annular bosses formed at the circumferential sides of the third corner hole 123 and the fourth corner hole 124 at the front surface 120 of the second plate 12 are in contact with a plate plane of the back surface of the first plate 11, such that the third corner hole 123 and the fourth corner hole 124 are isolated from the first flow passage formed between the front surface 120 of the second plate 12 and the back surface of the first plate 11. The structure of the first plate 11 is similar to that of the second plate 12, which will not be described herein.

Figure 4:
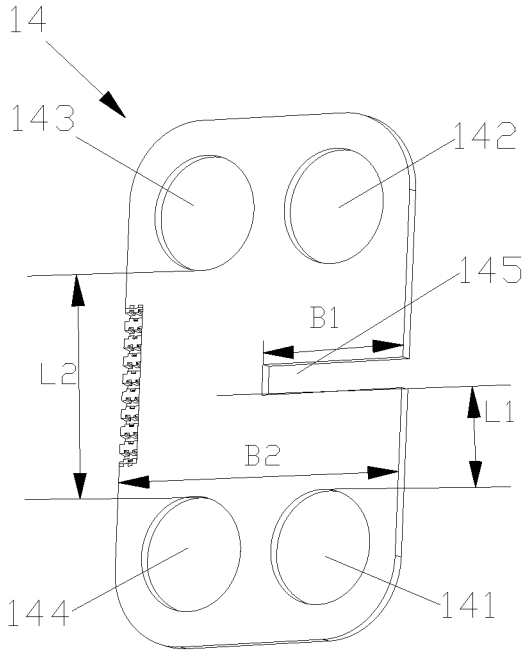
FIG. 4 is a schematic view showing the structure of a second fin of the plate heat exchanger shown in FIG. 1, in which for the sake of clarity, only a part of the fin structure is shown.

FIG. 4 is a schematic view showing the structure of the second fin 14. In order to clearly show the structure of the fin, the fin structure is only shown in a partial region of the figure, and is not shown in other regions.

As shown in FIG. 4, the second fin 14 includes a first hole 141, a second hole 142, a third hole 143, and a fourth hole 144 located at four corners, the first hole 141, the second hole 142, the third hole 143 and the fourth hole 144 of the second fin 14 correspond to the first corner hole 121, the second corner hole 122, the third corner hole 123 and the fourth corner hole 124 of the second plate 12, respectively. Inner diameters of the third hole 143 and the fourth hole 144 are larger than inner diameters of the third corner hole 123 and the fourth corner hole 124, so that the third hole 143 and the fourth hole 144 can be sleeved on the annular bosses formed at the circumferential sides of the third corner hole 123 and the fourth corner hole 124 respectively.

The second fin 14 is further provided with a notch 145. The notch 145 is located between the first hole 141 and the second hole 142, and the notch 145 extends from a side close to the first hole 141 and the second hole 142 of the second fin 14 to an opposite side. As shown in the figure, a length of a fin region between the first hole 141 and the second hole 142 is L2, and a length of a fin region between the first hole 141 and the notch 145 is L1. L1 and L2 satisfy: $\frac{1}{4} \leq L1/L2 \leq \frac{3}{4}$. L1 is half of L2 in this embodiment. A width of the notch 145 is B1, and a width of the second fin 14 is B2. B1 and B2 satisfy: $\frac{1}{4} \leq B1/B2 \leq \frac{3}{4}$, or $\frac{1}{4} \leq B1/B2 \leq \frac{1}{2}$. B1 is half of B2 in this embodiment.

Figure 5:
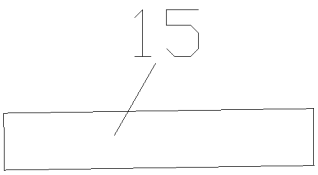
FIG. 5 is a schematic view showing the structure of a baffle of the plate heat exchanger shown in FIG. 1.

FIG. 5 shows the structure of the baffle 15. The baffle 15 may be made of a metal material. A size of the baffle 15 matches with a size of the notch 145, and the baffle 15 and the notch 145 may be in a clearance fit. Surfaces of the baffle 15 and the notch 145 are provided with a composite layer for welding. A height of the baffle 15, a height of the second fin 14 and heights of the annular bosses formed at the circumferential sides of the third corner hole 123 and the fourth corner hole 124 of the second plate 12 are substantially the same, which facilitates improving the stability of the welding.

The first fin 13 differs from the second fin 14 mainly in that no notch is provided at the first fin 13. The fin structures (for example, a louver size) of the first fin 13 and the second fin 14 may be the same or different. The fin structure is determined by a refrigerant in the flow passages, which will not be described in detail herein. Other structures of the first fin 13 may be the same as or similar to that of the second fin 14, which will not be described herein.

Figure 6:
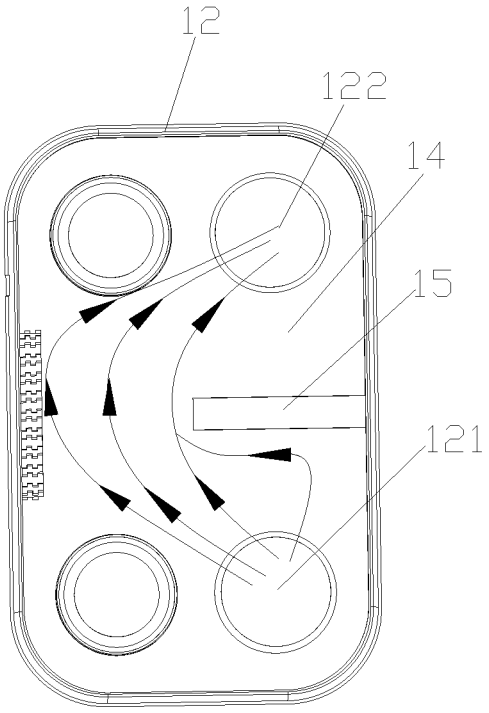
FIG. 6 is a structural schematic view showing an assembly of the second plate, the second fin and the baffle of the plate heat exchanger shown in FIG. 1, where arrows indicate the flow directions of a fluid.

FIG. 6 is a structural schematic view showing an assembly of the second plate 12, the second fin 14 and the baffle 15, and the second plate 12, the second fin 14 and the baffle 15 may be welded together by brazing or the like.

As shown in FIG. 6, the refrigerant first flows from the first corner hole 121 into the portions of the first flow passage located between the back surface of the first plate 11 and the front surface of the second plate 12, and then flows to the second corner hole 122 in a direction indicated by arrows. Since the baffle 15 is provided, a region in which a distance between the first corner hole 121 and the second corner hole 122 is short is blocked by the baffle 15, and the refrigerant is required to bypass the baffle 15 to flow to the second corner hole 122. In this way, the difference between lengths of flow paths in regions of the plate plane of the second plate 12 when the refrigerant flows from the first corner hole 121 to the second corner hole 122 may be reduced, besides, more refrigerant passes through a left side region of the plate plane and flows to the second corner hole 122, while a region of the back surface of the second plate 12 opposite to the left side region has more cooling liquid, thus a big heat exchange temperature difference is formed between the refrigerant and the cooling liquid, and thereby improving the heat exchange performance.

Moreover, when the cooling liquid flows from the third corner hole to the fourth corner hole, a temperature of the cooling liquid around the third corner hole is relatively high. Since the baffle 15 is provided, more refrigerant is allowed to flow around the third corner hole, so that heat of the cooling liquid can be fully adsorbed, and thus further ensuring a superheat degree of the refrigerant.

The problem of uneven distribution of the refrigerant in the first flow passage can be effectively solved according to this embodiment. In a case that a length of the plate heat exchanger is short, for example, a ratio of a length to a width of the plate heat exchanger is in a range of 0.7 to 2, the heat exchange performance can be effectively improved.

It should be noted that, a baffle may also be provided between the front surface of the first plate 11 and the back surface of the second plate 12, which will not be described herein.

Figure 7:
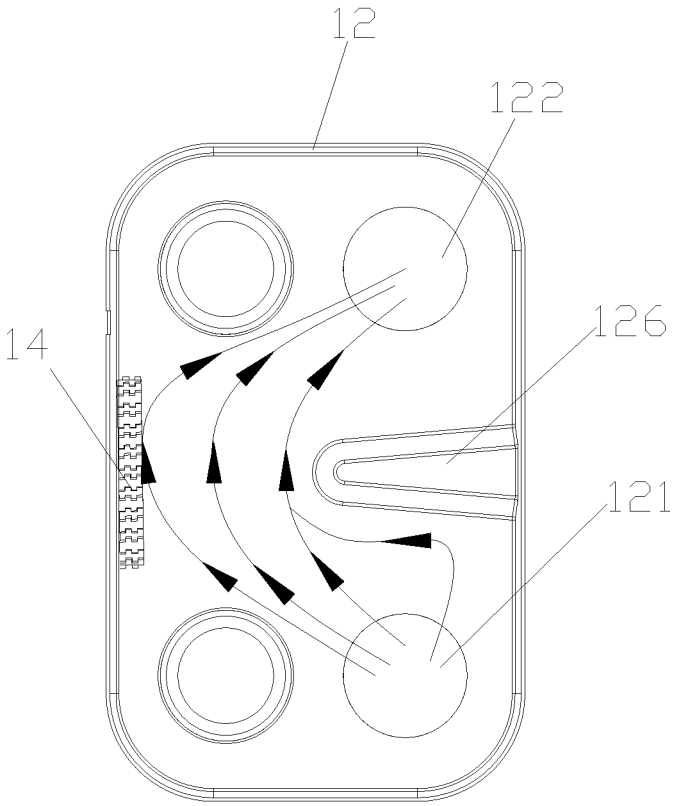
FIG. 7 is a structural schematic view showing an assembly of a second plate, a second fin and a baffle of a plate heat exchanger according to another embodiment of the present application.

FIG. 7 shows another embodiment of the present application. What is different from the above embodiment is that, in this embodiment, no baffle is arranged between the back surface of the first plate and the front surface of the second plate. A rib 126 protruding from the front surface of the second plate 12 by a certain distance is formed on the second plate 12 by stamping. The rib 126 protrudes from the front surface of the second plate 12 by a height substantially equal to the height of the second fin 14. By replacing the baffle 15 in the above embodiment with the rib 126 of an integral structure, the structure of the plate heat exchanger is simple, and the processing and installation are convenient; besides, the rib can better cooperate with the fin.

Other structures and features of this embodiment are the same as or similar to those of the above embodiment, which will not be described herein.

Figure 8:
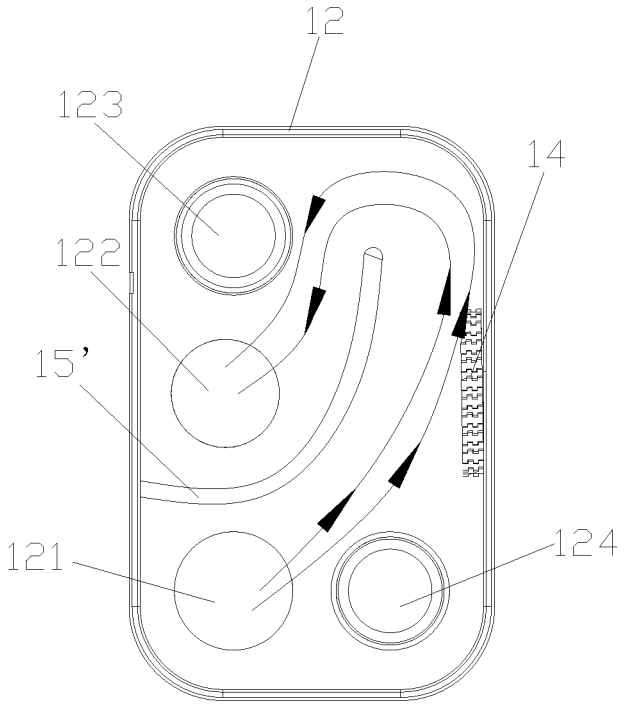
FIG. 8 is a structural schematic view showing an assembly of a second plate, a second fin and a baffle of a plate heat exchanger according to yet another embodiment of the present application.

FIG. 8 shows yet another embodiment of the present application. What is different from the above embodiments is that, in this embodiment, the first corner hole 121, the third corner hole 123 and the fourth corner hole 124 of the second plate 12 are located at three of the four corners of the second plate 12, respectively, and the third corner hole 123 and the fourth corner hole 124 are located at two opposite corners. The second corner hole 122 is located between the first corner hole 121 and the third corner hole 123. An arc-shaped baffle 15' is further arranged between the first corner hole 121 and the second corner hole 122, and one end of the baffle 15' is close to a corner of the second plate 12 where no corner hole is provided. In this way, during the fluid flowing from the first corner hole 121 to the second corner hole 122, the fluid can flow around sufficiently, so that the flow path of the fluid is long enough, which avoids uneven fluid distribution due to a too short distance between the first corner hole 121 and the second corner hole 122, and thereby improving the heat exchange performance. Moreover, in this embodiment, the distance between the first corner hole 121 and the second corner hole 122 is short, which facilitates adjusting the distance between the first corner hole 121 and the second corner hole 122. Besides, in a case that the first connecting opening 21 and the second connecting opening 22 corresponding to the first corner hole 121 and the second corner hole 122 respectively are mounted to expansion valves, since a distance between the first connecting opening 21 and the second connecting opening 22 can be adjusted to correspond to connecting openings of the expansion valves, the structure of the adapting block may be relatively simple, and the expansion valves can be directly mounted to the plate heat exchanger in an easier manner.

It should be noted that, the baffle 15' may also be of a rib structure formed by stamping. Other structures of this embodiment are the same as or similar to those of the above embodiments, which will not be described herein.

Figure 9:
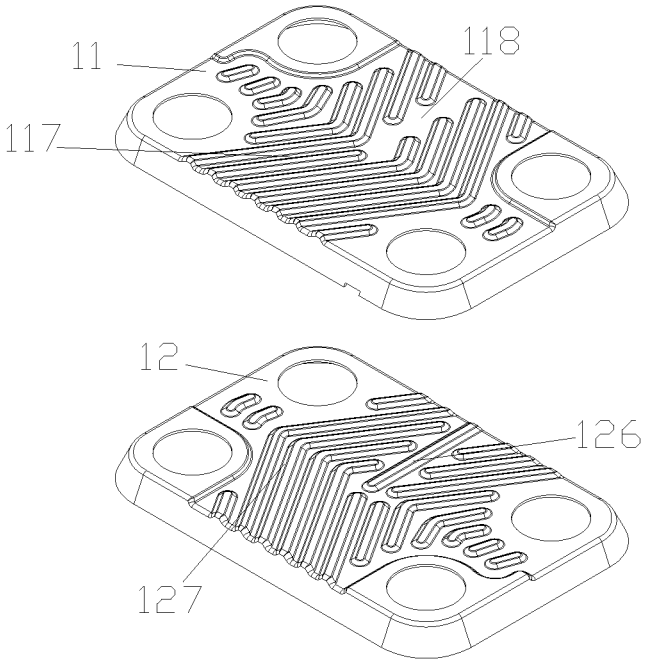
FIG. 9 is a structural schematic view showing an assembly of a second plate, a second fin and a baffle of a plate heat exchanger according to still another embodiment of the present application.

FIG. 9 shows still another embodiment of the present application. What is different from the above embodiments is that, in this embodiment, a fin structure is not provided, while a concave-convex structure 117 formed by stamping is provided in the first plate 11, a concave-convex structure 127 formed by stamping is also provided in the second plate 12, a rib 126 formed by stamping is further arranged at the second plate 12, and the rib 126 and the concave-convex structure 127 may be formed by a same processing step. A plane portion 118 is arranged at a portion of the first plate 11 corresponding to the rib 126. By providing the plane portion 118, on the one hand, flow resistance in the region where a distance between the third corner hole and the fourth corner hole of the first plate 11 is relatively long may be reduced, so that the fluid can be evenly distributed, on the other hand, the rib 126 can better cooperate with the back surface of the first plate 11.

It should be noted that, a baffle may be provided instead of the rib, and a portion where the rib is arranged is provided with a plane structure cooperating with the baffle. Other structures and features of this embodiment are the same as or similar to those of the above embodiments, which will not be described herein.

The embodiments described hereinabove are only specific embodiments of the present application, rather than limitation of the present application in any form. Although the present application is disclosed by the above preferred embodiments, the preferred embodiments should not be interpreted as a limitation to the present application. For those skilled in the art, many variations, modifications or equivalent replacements may be made to the technical solutions of the present application by using the methods and technical contents disclosed hereinabove, without departing from the scope of the technical solutions of the present application. Therefore, any simple modifications, equivalent replacements and modifications, made to the above embodiments based on the technical essences of the present application without departing from the technical solutions of the present application, are deemed to fall into the scope of the technical solution of the present application.

What we claim is:

1. A plate heat exchanger, comprising a heat exchange core, and a first flow passage and a second flow passage isolated from each other being formed in the heat exchange core, wherein the heat exchange core comprises first plates and second plates, each of the first plates comprises a front surface and a back surface at an opposite side of the front surface, and each of the second plates comprises a front surface and a back surface at an opposite side of the front surface;

portions of the second flow passage are formed between the front surfaces of the first plates and the back surfaces of the adjacent second plates, and portions of the first flow passage are formed between the front surfaces of the second plates and the back surfaces of the adjacent first plates;

each of the first plates comprises a first corner hole, a second corner hole, a third corner hole and a fourth corner hole, and each of the second plates also comprises a first corner hole, a second corner hole, a third corner hole and a fourth corner hole; the first corner hole, the second corner hole, the third corner hole and the fourth corner hole of each of the first plates are arranged to correspond to the first corner hole, the second corner hole, the third corner hole and the fourth corner hole of each of the second plates, respectively;

the first corner hole, the third corner hole and the fourth corner hole of each of the second plates are provided at three of four corners of the second plate, respectively, and the third corner hole and the fourth corner hole are diagonally arranged; each of the second plates comprises a first length side and a first width side which are close to the third corner hole, and a second length side and a second width side which are close to the fourth corner hole; the first corner hole, the second corner hole and the third corner hole are arranged along the first length side, and the second corner hole is located between the first corner hole and the third corner hole;

the first corner hole and the second corner hole of each of the second plates are in communication with each other, a blocking member is arranged between the front surface of each of the second plates and the back surface of the corresponding first plate, the blocking member extends along the front surface of each of the second plates from a position of the first length side, located between the first corner hole and the second corner hole, toward the first width side in a curved manner; the blocking member is located between the first corner hole and the second corner hole of the second plate, one end of the blocking member is located at a side portion of the heat exchange core, another end of the blocking member is close to a corner of the four corners of the second plate where no corner hole is provided, and the first corner hole of the second plate is in communication with the second corner hole of the second plate by rounding the another end of the blocking member.

2. The plate heat exchanger according to claim 1, wherein the heat exchange core further comprises fins, and each of the fins is arranged between the front surface of the corresponding second plate and the back surface of the corresponding first plate;

each of the fins comprises a first hole, a second hole, a third hole, and a fourth hole; which correspond to the first corner hole, the second corner hole, the third corner hole and the fourth corner hole of the second plate, respectively; and each of the fins is further provided with a notch, the notch is located between the first hole and the second hole, the notch extends from a side close to the first hole and the second hole to an opposite side; the blocking member is arranged at the notch, and the notch is in a clearance fit with the blocking member.

3. The plate heat exchanger according to claim 1, wherein the blocking member is a baffle, and the baffle and each of the second plates are fixed together by welding.

4. The plate heat exchanger according to claim 1, wherein the blocking member is a rib protruding from the front surface of each of the second plates by a certain distance, each of the second plates is stamped to form the rib, and the rib and the corresponding second plate are integrated.

5. The plate heat exchanger according to claim 1, wherein the number of the portions of the second flow passage formed between the front surfaces of the first plates and the back surfaces of the second plates is n1, the number of the portions of the first flow passage formed between the front surfaces of the second plates and the back surfaces of the first plates is n2, and n2 is greater than n1.

6. The plate heat exchanger according to claim 1, wherein each of the first plates and each of the second plates are respectively provided with a concave-convex structure formed by stamping, a portion of each of the first plates corresponding to the blocking member is provided with a plane portion, and/or a portion of each of the second plates corresponding to the blocking member is provided with a plane portion, and, the blocking member and the plane portion of each of the first plates are fixed together by welding and/or the plane portion of each of the second plates are fixed together by welding.

7. The plate heat exchanger according to claim 1, wherein another blocking member is further arranged between the front surface of each of the first plates and the back surface of the corresponding second plate, the another blocking member is located between the third corner hole and the fourth corner hole of the first plate, one end of the another blocking member is located at another side portion of the heat exchange core, and the third corner hole of the first plate bypasses another end of the another blocking member to communicate with the fourth corner hole of the first plate.

8. The plate heat exchanger according to claim 2, wherein the blocking member is a rib protruding from the front surface of each of the second plates by a certain distance, each of the second plates is stamped to form the rib, and the rib and the corresponding second plate are integrated.

9. The plate heat exchanger according to claim 2, wherein another blocking member is further arranged between the front surface of each of the first plates and the back surface of the corresponding second plate, the another blocking member is located between the third corner hole and the fourth corner hole of the first plate, one end of the another blocking member is located at another side portion of the heat exchange core, and the third corner hole of the first plate bypasses another end of the another blocking member to communicate with the fourth corner hole of the first plate.

10. The plate heat exchanger according to claim 4, wherein another blocking member is further arranged between the front surface of each of the first plates and the back surface of the corresponding second plate, the another blocking member is located between the third corner hole and the fourth corner hole of the first plate, one end of the another blocking member is located at another side portion of the heat exchange core, and the third corner hole of the first plate bypasses another end of the another blocking member to communicate with the fourth corner hole of the first plate.

* * * * *